US008062102B2

(12) United States Patent
Park et al.

(10) Patent No.: US 8,062,102 B2
(45) Date of Patent: Nov. 22, 2011

(54) POLISHING PADS INCLUDING SLURRY AND CHEMICALS THEREON AND METHODS OF FABRICATING THE SAME

(75) Inventors: Moo-Yong Park, Gyeonggi-do (KR); Jong-Won Lee, Gyeonggi-do (KR); Sang-Rok Ha, Seoul (KR); Hong-Seong Son, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 694 days.

(21) Appl. No.: 10/922,778

(22) Filed: Aug. 20, 2004

(65) Prior Publication Data

US 2005/0086869 A1 Apr. 28, 2005

(30) Foreign Application Priority Data

Aug. 29, 2003 (KR) ..... 10-2003-0060261

(51) Int. Cl.
*B24D 11/00* (2006.01)

(52) U.S. Cl. ..... 451/527; 51/297; 51/309; 451/533; 451/539

(58) Field of Classification Search ..... 51/297, 51/295, 298, 300, 307, 308, 309; 451/526, 451/527, 528, 529, 530, 534, 537, 548, 550
See application file for complete search history.

(56) References Cited

U.S. PATENT DOCUMENTS

| | | | | |
|---|---|---|---|---|
| 5,778,481 | A * | 7/1998 | Amsden et al. | 15/230.16 |
| 6,217,426 | B1 * | 4/2001 | Tolles et al. | 451/285 |
| 6,319,108 | B1 * | 11/2001 | Adefris et al. | 451/533 |
| 6,332,832 | B1 * | 12/2001 | Suzuki | 451/41 |
| 6,346,032 | B1 | 2/2002 | Zhang et al. | |
| 6,533,893 | B2 * | 3/2003 | Sabde et al. | 156/345.12 |
| 6,612,917 | B2 * | 9/2003 | Bruxvoort | 451/533 |
| 6,672,951 | B2 * | 1/2004 | Walker et al. | 451/527 |
| 6,685,540 | B2 * | 2/2004 | Cherian et al. | 451/41 |
| 6,749,485 | B1 * | 6/2004 | James et al. | 451/41 |
| 6,817,926 | B2 * | 11/2004 | Kollodge et al. | 451/36 |
| 6,863,599 | B2 * | 3/2005 | Kramer | 451/285 |
| 7,070,480 | B2 * | 7/2006 | Moon et al. | 451/36 |
| 2002/0077037 | A1 * | 6/2002 | Tietz | 451/41 |
| 2005/0272335 | A1 * | 12/2005 | Johnson et al. | 442/101 |

FOREIGN PATENT DOCUMENTS

| | | |
|---|---|---|
| JP | 2000301450 | 10/2000 |
| KR | 2000-025710 | 5/2000 |
| KR | 20010080622 | 8/2000 |

OTHER PUBLICATIONS

Korean Intellectual Office, "Notice to File a Response/Amendment to the Examination Report" corresponding to Korean Patent application 10-2003-0060261, mailed Jul. 28, 2005.

* cited by examiner

*Primary Examiner* — Timothy V Eley

(74) *Attorney, Agent, or Firm* — Myers Bigel Sibley & Sajovec

(57) ABSTRACT

Polishing pads are provided that include a substrate for a polishing pad and a plurality of spaced apart members on the substrate and protruding from the substrate. The plurality of members include at least one abrasive layer and at least one chemical additive layer. Related methods of fabricating polishing pads are also provided herein.

27 Claims, 4 Drawing Sheets

POLISHING PADS INCLUDING SLURRY AND CHEMICALS THEREON AND METHODS OF FABRICATING THE SAME

CLAIM OF PRIORITY

This application is related to and claims priority from Korean Patent Application No. 2003-60261, filed on Aug. 29, 2003, the disclosure of which is hereby incorporated herein by reference as if set forth in its entirety.

FIELD OF THE INVENTION

The present invention relates to integrated circuit devices and related methods of fabricating integrated circuit devices and, more particularly, to polishing pads and related methods of fabricating polishing pads.

BACKGROUND OF THE INVENTION

Fabrication of integrated circuit devices, such as memory devices, microprocessors, and the like, commonly involves the use of chemical mechanical polishing (CMP) to remove materials from a wafer surface and/or to planarize the surface of the wafer before building up additional structures. Generally, CMP involves rubbing the surface of the wafer against a polishing pad made of a resilient material, such as polyurethane, in the presence of a chemical slurry to remove material, such as a metallization layer, deposited on the wafer surface.

Several different types of CMP machines have been developed. One type of CMP machine uses a disk-shaped polishing pad that is affixed to a fixed or rotating polisher. An example of such a machine is illustrated in FIG. 1. As illustrated, the machine includes a polishing pad 12 affixed to a polisher 10 and a wafer 22 supported by a carrier 20. The carrier 20 typically rotates the wafer 22 and presses the rotating wafer's surface against the polishing pad 12. The polisher 10 may or may not rotate. A slurry 41 may be supplied between a wafer 22 and the polishing pad 12 from an external slurry supply device 40. The slurry 41 functions as a chemical polishing abrasive for use in the CMP process. The slurry 41 may be supplied from the external slurry supply device 40 through a supply nozzle 60 while the wafer 22 is pressed and rotated on the polishing pad 12. Generally, the supply nozzle 60 extends to a central portion of the polishing pad 12 and slurry 41 is pumped through the supply nozzle using the pump 42.

Furthermore, chemicals 31 and deionized water 51 may also be supplied to the polishing pad 12 by an external chemical supply device 30 and the external deionized water supply device 50, respectively, through the supply nozzle 60 using first and second pumps 32 and 52, respectively. The slurry 41, chemicals 31 and deionized water 51 may be mixed at a certain point and supplied to the polishing pad 12. The polishing pad 12 may include grooves and the mixture of slurry 41, chemicals 31 and deionized water 51 may be provided in the grooves of the polishing pad 12. Accordingly, the mixture of the slurry 41, chemicals 31 and deionized water 51 may be used to polish the wafer 22 as the wafer is pressed and rotated on the surface of polishing pad 12 during the CMP process.

As discussed above, the polishing pad 12 may have surface features, such as grooves, that can aid distribution of slurry across the surface of the wafer, as shown in, for example, U.S. Pat. No. 6,561,873 to Tsai et al. CMP machines that impress a spinning wafer against a belt-type polishing pad, as shown, for example, in U.S. Pat. No. 6,634,936 to Jensen et al. and U.S. Pat. No. 6,585,579 to Jensen et al.

Conventional polishing devices, for example, device 90 of FIG. 1, use external supply devices 30, 40 and 50 for supplying one or more of chemicals 31, a slurry 41 and deionized water 51. The presence of these additional devices may require more space to operate the polishing device so that a CMP process can be performed. Furthermore, some conventional polishing devices receive the slurry through a first supply line and the chemicals through a second supply line. Providing the slurry and the chemicals through different supply lines may add an additional level of difficulty, as process conditions may vary depending on a mix ratio of slurry and chemicals.

SUMMARY OF THE INVENTION

Some embodiments of the present invention provide polishing pads including a substrate for the polishing pad and a plurality of spaced apart members on the substrate and protruding from the substrate. The plurality of members include at least one abrasive layer and at least one chemical additive layer.

In further embodiments of the present invention, the plurality of spaced apart members include at least one abrasive layer on at least one additive layer and/or at least one additive layer on at least one abrasive layer. The plurality of spaced apart members may include a first additive layer and a first abrasive layer on the substrate. A second abrasive layer may be provided on the first additive layer and a second additive layer may be provided on the first abrasive layer.

In still further embodiments of the present invention, the first abrasive layer and the second abrasive layer may include a similar abrasive material. Similarly, the first additive layer and the second additive layer may include a similar additive chemical.

In some embodiments of the present invention, a height of the first additive layer may be similar to a height of the first abrasive layer and a height of the second additive layer may be similar to a height of the second abrasive layer. In certain embodiments of the present invention, a height of the first additive layer may be similar to a height of the second abrasive layer and a height of the second additive layer may be similar to a height of the first abrasive layer. A height of the first additive layer may be similar to a height of the second additive layer and a height of the first additive layer may be similar to a height of the second abrasive layer.

In further embodiments of the present invention, the at least one abrasive layer and the at least one additive layer may be adhered to each other using a resin. The plurality of spaced apart members may have a similar circular shape or a similar polygonal shape. The polygonal shape may include a regular polygonal shape. Cross-sectional areas of the plurality of spaced apart members may be the same. Heights of the plurality of spaced apart members may be the same.

While the present invention is described above primarily with reference to polishing pads, methods of fabricating polishing pads are also provided herein.

DETAILED DESCRIPTION OF EMBODIMENTS OF THE PRESENT INVENTION

Figure 1:
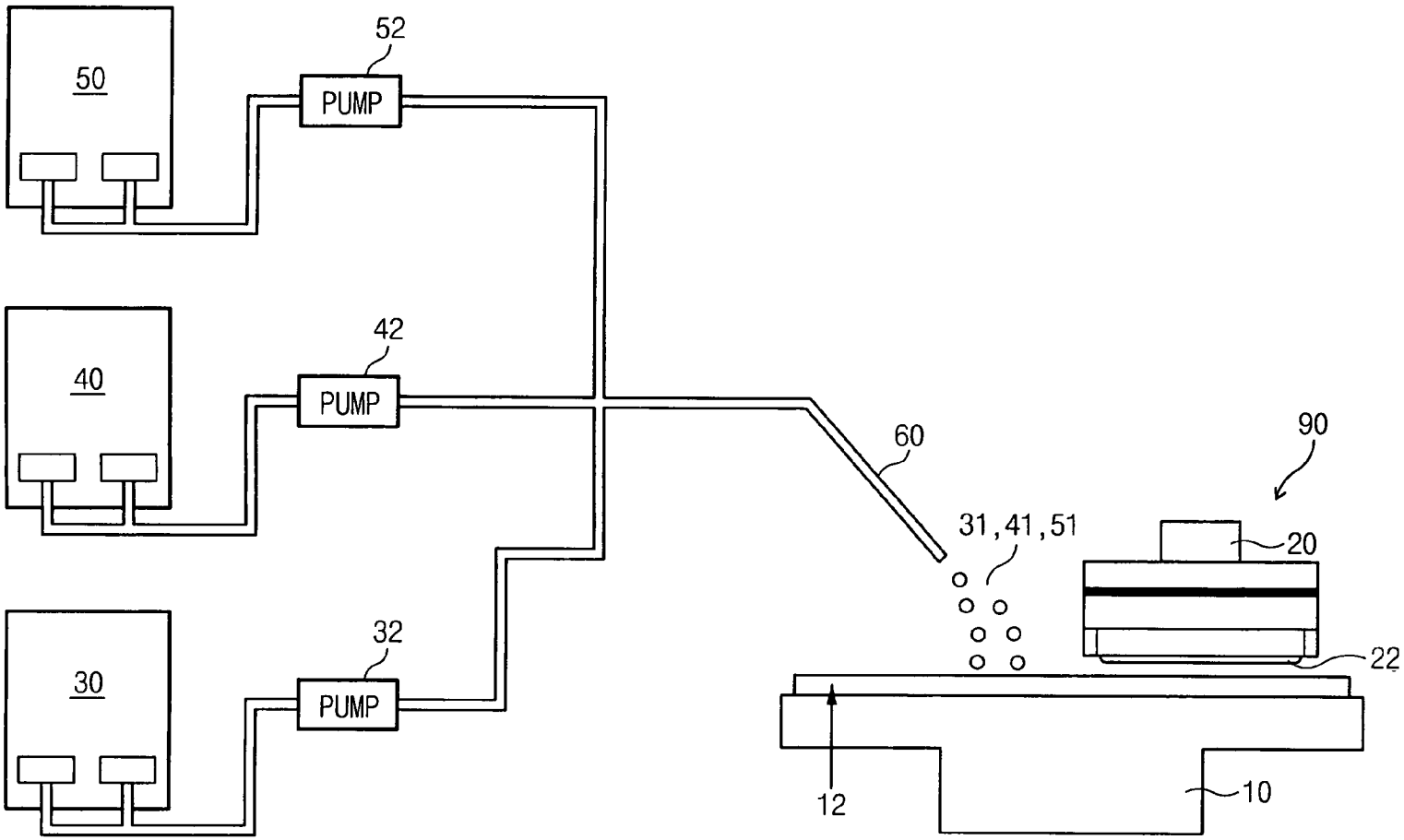
Fig. 1 (PRIOR ART)
FIG. 1 is a schematic block diagram illustrating conventional chemical mechanical polishing (CMP) processing devices.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element such as a layer, region or substrate is referred to as being "on" another element, it can be directly on the other element or intervening elements may also be present. The term "directly on" means that there are no intervening elements. It will be understood that, although the terms first, second, etc. may be used herein to describe various elements, these elements should not be limited by these terms. These terms are only used to distinguish one element from another. For example, a first layer could be termed a second layer, and, similarly, a second layer could be termed a first layer without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
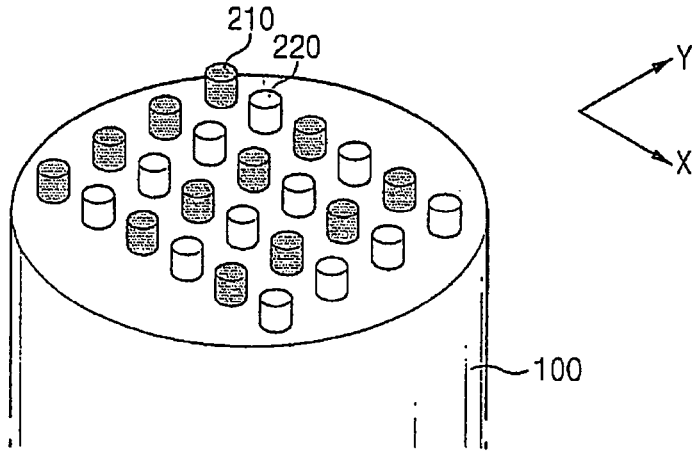
FIGS. 2 and 3 are perspective views illustrating methods of fabricating polishing pads according to some embodiments of the present invention.

Referring now to FIG. 2, a perspective view illustrating methods of fabricating polishing pads according to some embodiments of the present invention will be discussed. A substrate 100 for a polishing pad is prepared. The polishing pad may be used during, for example, a chemical mechanical polishing (CMP) process to remove materials from a wafer surface and/or to planarize the surface of the wafer before building up additional structures of semiconductor devices. Thus, the polishing pad is typically sufficiently stiff so as to allow a reaction product to be removed from a surface of a wafer or substrate, which may be chemically etched by a slurry. In certain embodiments of the present invention, the polishing pad may include, for example, polyurethane having some stiffness and elasticity or a foaming agent including polyester containing polyurethane.

A first abrasive layer (slurry) 210 is provided on the substrate 100 for the polishing pad. The first abrasive layer 210 may be uniformly formed on a surface of the substrate 100. The first abrasive layer 210 may include various kinds of materials capable of performing a polishing function. In certain embodiments of the present invention, the first abrasive layer 210 has a predetermined distance in the X direction considering the position of a first additive (chemical) layer 220, discussed below. However, this may not apply in the Y direction. The first abrasive layer 210 includes a polishing particle including, for example, metallic oxide materials. The metallic oxide materials used as the polishing particle may be, for example, ceria, silica, alumina, titania, zirconia and/or germania.

As further illustrated in FIG. 2, a first additive layer 220 is provided between the first abrasive layers 210. The first additive layer 220 may include various chemicals that may provide, for example, improved selectivity and/or planarization. The first additive layer 220 and the first abrasive layer 210 may be formed on the substrate 100 to have a similar pattern. In other words, as illustrated the first abrasive layers 210 and the first additive layers 220 may alternate in the X direction and may not alternate in the Y direction. The embodiments illustrated in FIG. 2 are provided for exemplary purposes only and, thus, embodiments of the present invention should not be limited to this configuration. For example, the first abrasive layers 210 and the first additive layers 220 may not alternate in the X direction and may alternate in the Y direction without departing from the scope of the present invention.

In some embodiments of the present invention, a height of the first abrasive layer 210 may be the same or similar to a height of the first additive layer 220. The first abrasive layer 210 may be formed before or after the first additive layer 220 without departing from the scope of the present invention.

Figure 3:
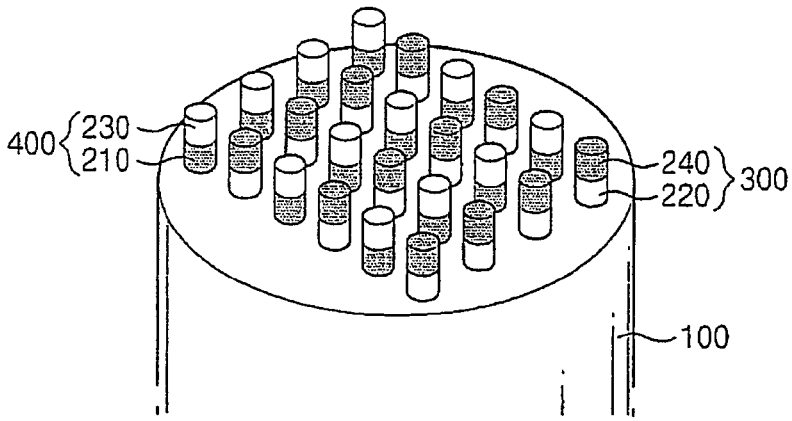

Referring now to FIG. 3, a perspective view illustrating methods of fabricating polishing pads according to further embodiments of the present invention will be discussed. As illustrated in FIG. 3, and a second abrasive layer 240 is provided on the first additive layer 220 to provide a plurality of first members 300 and a second additive layer 230 is provided on the first abrasive layer 210 to provide a Plurality of second members 400. The plurality of first and second members 300 and 400 may be referred to collectively herein as "members." The spaces between the first plurality of members 300 and the second plurality of members 400 may provide a groove on the substrate 100.

In some embodiments of the present invention, the second additive layer 230 may include the same additive material as the first additive layer 220 and the second abrasive layer 240 may include the same abrasive material as the first abrasive layer 210. For example, if the first abrasive layer includes cerium oxide ($CeO_2$), all of the first and second abrasive (slurry) layers 210 and 240 may also include $CeO_2$. Furthermore, if the first additive layer 220 includes a specific additive, the second additive layer 230 may also include the specific additive.

A lower portion of a first member 300 may include the first additive layer 220 and an upper portion of the first member 300 may include the second abrasive layer 240. A lower portion of a second member 400 may include the first abrasive layer 210 and an upper portion of the second member 400 may include the second additive layer 230. In some embodiments of the present invention, heights of the first members 300 may be the same or similar to heights of the second members 400. Accordingly, in certain embodiments, the second abrasive layer 240 and the second additive layers 230 may have the same or similar height.

In embodiments of the present invention where the plurality of first and second members 300 and 400 have the same heights, the abrasion of each of the plurality of first and second members 300 and 400 may be equal during the CMP process. Accordingly, when the second abrasive layers 240 and the second additive layers 230 are completely abraded during the CMP process, surfaces of the first additive layers 220 and the first abrasive layers 210 may be exposed.

If a height of the first abrasive layer 210 is different from a height of the first additive layer 220 and a height of the second abrasive layer 240 is different from a height of the second additive layer 230, the plurality of first and second members 300 and 400 may have different heights. Thus, when a CMP process is performed, the second additive layers 230 may all be abraded, exposing the first abrasive layer 210 under the second additive layers 230, but the second abrasive layer 240 may not be completely abraded and therefore possibly not expose the first additive layers 220 under the second abrasive layers 240. This may a cause a problem with a mix ratio of the abrasive and additive materials, which may cause an unwanted outcome of the CMP process.

Thus, typically the heights of the first and second members 300 and 400 are the same or similar. Furthermore, heights of the first abrasive and additive layers 210 and 220 may be about equal and heights of the second abrasive and additive layers 240 and 230 may be about equal, which by definition would make the heights of the first and second members 300 and 400 about the same. In certain embodiments of the present invention, heights of the first additive layers 220 may be approximately equal to heights of the second abrasive layers 240, and heights of the first abrasive layers 210 are approximately equal to that of the second additive layers 230.

During the CMP process, the abrasion of the first and second abrasive layers 210 and 240 and the first and second additive layers 220 and 230 may not be exactly the same, the surface levels of the first and second abrasive layers 220 and 230 after a polishing process may be different from those of the first and second additive layers 220 and 230. However, it may be possible to provide abrasive layers 210 and 240 and additive layers 220 and 230 having substantially equal surface levels by performing a conditioning process using a conditioner including, for example, diamond particles.

In some embodiments of the present invention, the first additive layer 220 and the second abrasive layer 240 of the first member 300 may be adhered using, for example, a resin. Furthermore, the resin may be mixed in each of the first additive layers 220 and the second abrasive layers 240. Similarly, the first abrasive layer 210 and the second additive layer 230 of the second member 400 may be adhered using, for example, a resin. Furthermore, the resin may be mixed in each of the second additive layers 230 and the first abrasive layers 210.

The plurality of first and second members 300 and 400 may have circular cross-sections. As discussed above, spaces between the plurality of first and second members 300 and 400 may provide a groove on the substrate 100. Accordingly, in embodiments of the present invention where the plurality of first and second members 300 and 400 have circular cross-sections, it may be possible to secure smooth flow of abrasive and additive materials.

Figure 4:
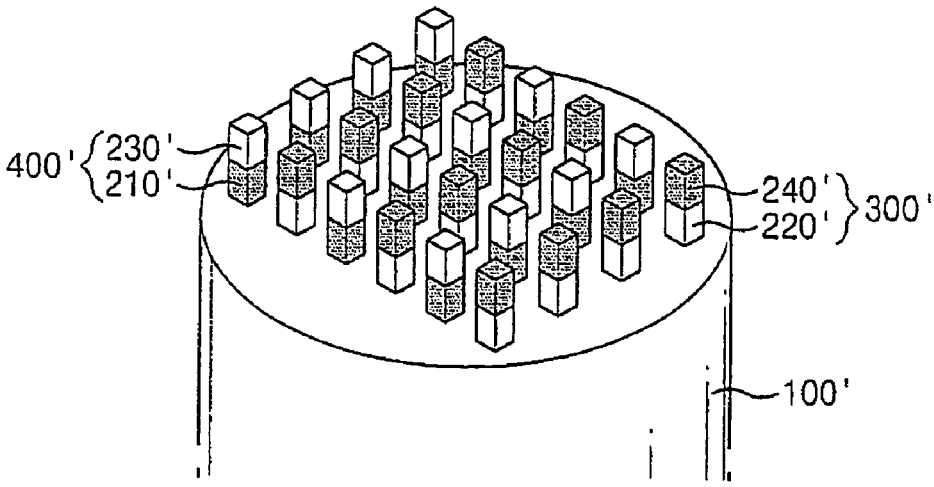
FIG. 4 is a perspective view illustrating methods of fabricating polishing pads according to further embodiments of the present invention.

Although the plurality of first and second members 300 and 400 illustrated in FIGS. 3 and 4 have circular cross-sections, embodiments of the present invention are not limited to this configuration. For example, as illustrated in FIG. 4, the cross-section of the plurality of first and second members 300' and 400' provided on a polishing pad substrate 100' may be a regular quadrilateral as well as a polygon. As illustrated, the plurality of first and second members 300' and 400' may include two layers, a first abrasive layer 210' under a second additive layer 230' or a first additive layer 220' under a second abrasive layer 240'. As stated above, in some embodiments of the present invention, the heights of each of the plurality of first and second members 300' and 400' may be about the same.

Although the plurality of first and second members 300 and 400 are illustrated in FIGS. 2 through 4 as having first and second layers, embodiments of the present invention are not limited to this configuration. For example, the plurality of first and second members 300 and 400 may include three or more layers without departing from the scope of the present invention. Furthermore, it will be understood that the plurality of first and second members 300 and 400 may have the same cross-sectional areas or different cross-sectional areas.

Figure 5:
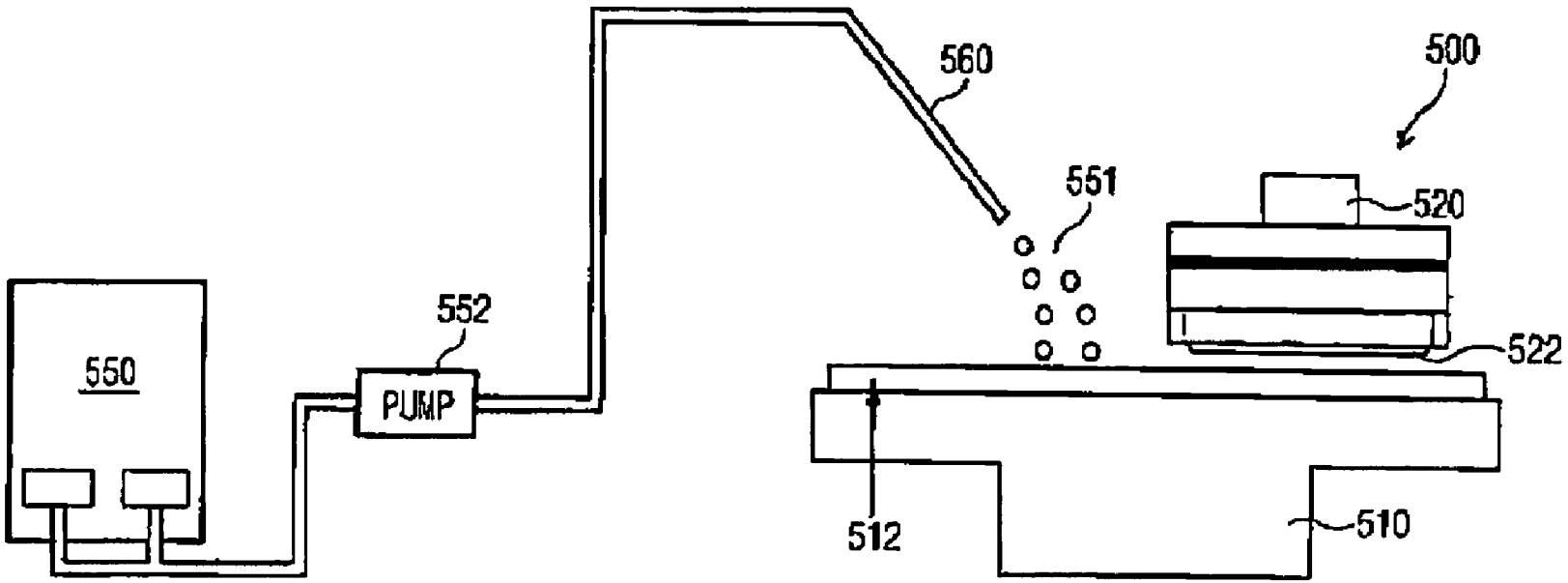
FIG. 5 is a CMP processing device using polishing pads according to some embodiments of the present invention.

Referring now to FIG. 5, a CMP processing device using a polishing pad according to some embodiments of the present invention will be discussed. As illustrated in FIG. 5, using a polishing pad 512 having abrasive and additive layers according to embodiments of the present invention, a chemical (additive) supply device 30 (FIG. 1) and/or a slurry (abrasive) supply device 40 (FIG. 1) may not be necessary. Thus, as further illustrated, only a deionized water device 550 may be used in a CMP process according to embodiments of the present invention, which may significantly reduce the amount of space required for the device.

As illustrated, the device 500 includes a polishing pad 512 according to embodiments of the present invention affixed to a polisher 510 and a wafer 522 supported by a carrier 520. The carrier 520 typically rotates the wafer 522 and presses the rotating wafer's surface against the polishing pad 512. The polisher 510 may or may not rotate. Accordingly, the surface of the wafer 522 is chemically and mechanically planarized by frictional force by rotation of the polisher 510 and/or the carrier 520, force pressing the wafer 522 and a chemical reaction by a slurry (abrasive) already included on the polishing pad 512. Deionized water 551 is supplied to the polishing pad 512 through a supply line 560 using an external deionized water supply device 550 and a pump 552.

As discussed briefly above with respect to FIGS. 2 through 5, embodiments of the present invention provide a polishing pad including a slurry (or abrasive) and chemicals (additives). The slurry is provided to allow efficient performance of a CMP process without the use of an external device supplying the slurry (abrasive). Furthermore, the chemicals are provided on the polishing cloth to provide improved selectivity or planarization without use of an external device supplying additional chemicals or additives. In other words, since an abrasive layer and an additive layer are already provided on the polishing pad, slurry and chemical supply devices may not be required in the CMP process. As a result, only an external device supplying deionized water may be needed to perform the CMP process. Accordingly, with application of the deionized water the slurry and chemicals are mixed on the polishing pad at the same time, thus, allowing process conditions (mix ratio of slurry and chemicals) to be controlled.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A polishing pad used during a chemical mechanical polishing process to planarize a surface of a wafer, the polishing pad comprising:

a stiff substrate adapted to allow a chemically etched product to be removed from the surface of the wafer; and a plurality of spaced apart members on the substrate and protruding from the substrate, each of the plurality of members comprising at least one abrasive layer and at least one chemical additive layer, wherein the chemical additive layer is different from the abrasive layer and is not abrasive and wherein the abrasive and additive layers are stacked vertically.

2. The polishing pad of claim 1, wherein the plurality of spaced apart members comprise at least one abrasive layer on at least one additive layer and/or at least one additive layer on at least one abrasive layer.

3. The polishing pad of claim 1, wherein the plurality of spaced apart members comprise:

a first additive layer and a first abrasive layer on the substrate;

a second abrasive layer on the first additive layer; and a second additive layer on the first abrasive layer.

4. The polishing pad of claim 3, wherein the first abrasive layer and the second abrasive layer comprise a similar abrasive material.

5. The polishing pad of claim 3, wherein the first additive layer and the second additive layer comprise a similar additive chemical.

6. The polishing pad of claim 3, wherein a height of the first additive layer is similar to a height of the first abrasive layer and wherein a height of the second additive layer is similar to a height of the second abrasive layer.

7. The polishing pad of claim 3, wherein a height of the first additive layer is similar to a height of the second abrasive layer and wherein a height of the second additive layer is similar to a height of the first abrasive layer.

8. The polishing pad of claim 3, wherein a height of the first additive layer is similar to a height of the second additive layer and wherein a height of the first abrasive layer is similar to a height of the second abrasive layer.

9. The polishing pad of claim 1, wherein the at least one abrasive layer and the at least one additive layer are adhered to each other using a resin.

10. The polishing pad of claim 1, wherein a height of the at least one additive layer is similar to a height of the at least one abrasive layer.

11. The polishing pad of claim 1, wherein the plurality of spaced apart members have a similar circular shape or a similar polygonal shape.

12. The polishing pad of claim 11, wherein the polygonal shape comprises a regular polygonal shape.

13. The polishing pad of claim 11, wherein cross-sectional areas of the plurality of spaced apart members are the same.

14. The polishing pad of claim 11, wherein heights of the plurality of spaced apart members are about the same.

15. A method of fabricating a polishing pad used during a chemical mechanical polishing process to planarize a surface of a wafer, the method comprising:

forming a plurality of spaced apart members that protrude from a stiff substrate adapted to allow a chemically etched product to be removed from the surface of the wafer, each of the plurality of spaced apart members including at least one abrasive layer and at least one additive layer on the substrate, wherein the chemical additive layer is different from the abrasive layer and is not abrasive and wherein the abrasive and additive layers are stacked vertically.

16. The method of claim 15, wherein forming the plurality of spaced apart members comprises forming at least one abrasive layer on at least one additive layer and/or forming at least one additive layer on at least one abrasive layer.

17. The method of claim 15, wherein forming the plurality of spaced apart members comprises:

forming a first additive layer and a first abrasive layer on the substrate;

forming a second abrasive layer on the first additive layer; and forming a second additive layer on the first abrasive layer.

18. The method of claim 17, wherein forming the first abrasive layer and forming the second abrasive layer comprise forming the first and second abrasive layers having similar abrasive materials.

19. The method of claim 17, wherein forming the first additive layer and forming the second additive layer comprise forming the first and second additive layers having similar additive chemicals.

20. The method of claim 17, wherein a height of the first additive layer is similar to a height of the first abrasive layer and wherein a height of the second additive layer is similar to a height of the second abrasive layer.

21. The method of claim 17, wherein a height of the first additive layer is similar to a height of the second abrasive layer and wherein a height of the second additive layer is similar to a height of the first abrasive layer.

22. The method of claim 17, wherein a height of the first additive layer is similar to a height of the second additive layer and wherein a height of the first abrasive layer is similar to a height of the second abrasive layer.

23. The method of claim 15, wherein forming the at least one abrasive layer and forming the at least one additive layer comprise adhering the at least one abrasive layer and the at least one additive layer to each other using a resin.

24. The method of claim 15, wherein a height of the at least one additive layer is similar to a height of the at least one abrasive layer.

25. The method of claim 15, wherein the plurality of spaced apart members have a similar circular shape or a similar polygonal shape.

26. The method of claim 25, wherein the polygonal shape comprises a regular polygonal shape.

27. The method of claim 25, wherein cross-sectional areas of the plurality of spaced apart members are about the same.

* * * * *